US009078551B2

(12) United States Patent
Rieger et al.

(10) Patent No.: US 9,078,551 B2
(45) Date of Patent: Jul. 14, 2015

(54) DISHWASHER

(75) Inventors: Roland Rieger, Rainau (DE); Michael Rosenbauer, Reimlingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1032 days.

(21) Appl. No.: 12/719,031

(22) Filed: Mar. 8, 2010

(65) Prior Publication Data

US 2010/0229901 A1 Sep. 16, 2010

(30) Foreign Application Priority Data

Mar. 10, 2009 (DE) ..... 10 2009 001 429

(51) Int. Cl.

| | |
|---|---|
| ***B08B 3/00*** | (2006.01) |
| ***A47L 15/00*** | (2006.01) |
| ***A47L 15/42*** | (2006.01) |
| ***A47L 15/46*** | (2006.01) |

(52) U.S. Cl.

CPC ..... *A47L 15/0021* (2013.01); *A47L 15/4217* (2013.01); *A47L 15/46* (2013.01); *A47L 2301/00* (2013.01); *A47L 2401/12* (2013.01); *A47L 2501/04* (2013.01); *A47L 2501/05* (2013.01); *A47L 2501/06* (2013.01); *A47L 2501/30* (2013.01)

(58) Field of Classification Search

CPC .... B22F 7/08; B22F 2998/00; B22F 2998/10; A47L 2501/05; A47L 15/0049

USPC ..... 134/56 D, 46 R, 57 R, 57 D, 58 R, 58 D; 68/12.01, 12.02, 12.03, 12.21, 12.22, 68/12.23; 8/137

See application file for complete search history.

(56) References Cited

U.S. PATENT DOCUMENTS

| | | | | |
|---|---|---|---|---|
| 4,296,768 | A * | 10/1981 | Saucedo | 134/47 |
| 6,622,754 | B1 * | 9/2003 | Roth et al. | 134/18 |
| 6,694,990 | B2 * | 2/2004 | Riddell et al. | 134/57 D |
| 7,959,744 | B2 * | 6/2011 | Sundaram et al. | 134/56 D |
| 8,092,611 | B2 * | 1/2012 | Hatfield et al. | 134/18 |
| 2006/0237052 | A1 * | 10/2006 | Picardat et al. | 134/56 D |
| 2007/0137709 | A1 * | 6/2007 | Kempf et al. | 137/337 |
| 2007/0246072 | A1 * | 10/2007 | Kim | 134/18 |

FOREIGN PATENT DOCUMENTS

| | | | | |
|---|---|---|---|---|
| DE | 4001279 | A1 | 7/1991 | |
| DE | 10054957 | A1 * | 5/2002 | A47L 15/42 |
| WO | 2008080786 | A1 | 7/2008 | |

OTHER PUBLICATIONS

Steiner et al., "Program control method for water-carrying domestic machine involves automatically varying duration of individual washing stages depending on water inlet", May 2002, DE 100 54 957—Machine Translation.*

* cited by examiner

*Primary Examiner* — Michael Barr
*Assistant Examiner* — Thomas Bucci
(74) *Attorney, Agent, or Firm* — James E. Howard; Andre Pallapies

(57) ABSTRACT

A domestic dishwasher, comprising an attachment device for receiving intake water and an execution control device in which are stored one or more washing programs for controlling an execution of a wash cycle for washing dishes, wherein the execution control device is designed to adapt at least one parameter of at least one of the washing programs to a temperature of the fresh water.

23 Claims, 5 Drawing Sheets

DISHWASHER

BACKGROUND OF THE INVENTION

The present invention relates to a dishwasher, in particular a domestic dishwasher, comprising an attachment device for receiving intake water and an execution control device in which are held one or more washing programs for controlling an execution of one or more wash cycles.

A domestic dishwasher which is known from practice for the purpose of washing dishes has a closable washing compartment, into which the dishes can be inserted for the purpose of cleaning. The known domestic dishwasher further comprises an attachment device which can be attached to an external fresh water source for the purpose of receiving fresh water. In practice, the fresh water source is a water line of a water supply that is installed in a building. The attachment device is connected to the washing compartment in such a way that the fresh water received by the attachment device can be carried into the washing compartment, where it is used as dishwashing water.

The domestic dishwasher also has a circulating pump, which allows dishwashing water that collects in a lower region of the washing compartment to be sprayed onto the dishes by means of a spray device. The dishwashing water then returns to the lower region of the washing compartment due to gravity, thereby forming a closed circulation loop.

An electrical heating device is arranged in the circulation loop in this case, allowing the dishwashing water to be brought to a predetermined temperature during dishwashing. In order that the heating device can be selectively controlled in this case, provision is further made for a sensor for the temperature of the dishwashing water. The known dishwasher also has drain pump, which allows dishwashing water to be pumped out when it is no longer required.

For the purpose of controlling the execution of a washing process, which is usually referred to as a wash cycle, the dishwasher has an execution control device. In this case, an execution control device is understood to mean a control device which controls an execution of a wash cycle according to predetermined steps.

The steps required to carry out a wash cycle, and the transition conditions for the change from one step to a subsequent step, are specified in a washing program in this case. In this case, a washing program contains all the information that is required by the execution control device for the purpose of automatically controlling the execution of a wash cycle. This results in a high level of operating convenience, since the operator, after starting a washing program, no longer needs to worry about the further execution of the wash cycle.

A typical wash cycle comprises (in this chronological sequence) a prewash cycle, a cleaning cycle, an intermediate wash cycle, a rinsing cycle and a drying cycle. In this case, the intermediate wash routine can be omitted or replaced (partly or completely) by a drain routine if applicable.

After the operator has started a corresponding washing program, the prewash cycle is started, wherein intake water (in particular fresh water) is introduced into the dishwasher by corresponding activation of the intake water receiving device. Corresponding activation of the circulating pump then causes the intake water to be circulated as dishwashing water in order to remove heavy soiling from the dishes. After a predetermined time, at least some of the now soiled dishwashing water is pumped out as a result of corresponding activation of the drain pump, and the prewash cycle is terminated.

At the start of the subsequent cleaning cycle, further intake water (in particular fresh water) is introduced into the washing compartment as a result of renewed activation of the receiving device. Said intake water is heated, in a heating phase of the cleaning cycle, by activation of the heating device. During the heating phase of the cleaning cycle, detergent is usually added to the dishwashing water that is held in the washing compartment at this stage, by means of a detergent dosing device which is controlled by the execution control device. Furthermore, during the heating phase of the cleaning cycle, the circulating pump is controlled in such a way that the dishwashing water is circulated so that even stuck-on soiling can be removed from dishes. When the temperature of the wash cycle reaches a value that is predetermined by the washing program, this is detected by means of the sensor for the temperature of the wash cycle, whereupon the execution control device switches off the heating device. After completion of the heating phase of the cleaning cycle, a postwash or post-cleaning phase of the cleaning cycle is carried out for a predetermined period, during which the dishwashing water continues to be circulated. At the end of the postwash phase, the drain pump is activated again such that at least some of the dishwashing water from the cleaning cycle is pumped out.

At the start of the intermediate wash cycle which now follows if applicable, the dishwashing water in the washing compartment is topped up again with intake water via the receiving device, in particular fresh water. The dishwashing water of the intermediate wash cycle is not usually heated, but is circulated by means of the circulating pump. In particular, the intermediate wash cycle allows detergent residues to be removed from the dishes. After expiry of a predetermined period, at least some of the dishwashing water from the intermediate wash cycle, which now includes the detergent residues, is pumped out.

At the start of the subsequent rinsing cycle, the receiving device is activated again for the purpose of introducing intake water, in particular fresh water, into the washing compartment. This is mixed with rinse-aid by a rinse-aid dispenser, heated by means of activating the heating device and circulated by means of corresponding activation of the circulating pump. When an intended temperature is reached, the circulating pump and the heating device are switched off. The dishwashing water is then pumped out via the drain pump and the rinsing cycle is terminated. The rinsing cycle is intended in particular to prevent the formation of stains on the cleaned dishes, and this is essentially achieved by the chemical properties of the rinse-aid. The rinsing cycle is also intended generally to prepare the dishes for the subsequent drying cycle, by heating them to a relatively high temperature.

During the subsequent drying cycle, during which no new dishwashing water is introduced into the washing compartment, any still-adhering dishwashing water evaporates due to the high temperature of the dishes. This water then condenses primarily on the walls of the washing compartment and collects in a lower region of the washing compartment. From there, the dishwashing water is pumped out after a predefined time by means of the drain pump and the drying cycle is terminated.

The basic execution of a typical wash cycle described above can be varied in many and diverse ways. For example, different time constants or different temperatures can be specified. It is also possible to omit individual partial wash cycles, e.g. the prewash cycle and/or intermediate wash cycle, or to repeatedly carry out individual partial wash cycles, e.g. the prewash routine, intermediate wash cycle or cleaning cycle, or to insert a plurality of partial wash cycles in series, e.g. a plurality of prewash routines, intermediate wash cycles and/or cleaning routines. In this way, the intended execution of the wash cycle can be adapted to various applications scenarios.

In the case of modern dishwashers, provision is therefore usually made for a plurality of washing programs for controlling the execution of a wash cycle. In this case, the operator has the possibility of selecting a suitable washing program depending on the application scenario. For example, in addition to a normal washing program, provision can be made for an intensive washing program in order to achieve a greater cleaning effect, an energy-saving washing program in order to reduce the energy requirement and/or a delicate washing program for delicate treatment of the dishes. Provision can also be made for a further washing program which is adapted to the volume of the load and/or the type of dishes. All of the cited washing programs can also be provided in a quick-wash variant which is intended to reduce the overall duration of the wash cycle.

In this case, each of the washing programs is configured in such a way that, taking into consideration further specifications such as e.g. maximal wash cycle duration or maximal stress on the dishes, a defined cleaning and/or drying effect can be achieved with maximal efficiency using a wash cycle which is based on the relevant washing program. In this case, the efficiency corresponds to the relationship between the washing result that is achieved and the effort that is required to achieve it.

The known dishwasher has the disadvantage that the actual execution of a wash cycle is dependent not only on the selected washing program, but also on environmental conditions. Consequently, the desired cleaning and/or drying effect can only be ensured in an efficient manner if the dishwasher is operated under standard conditions. However, if the dishwasher is operated under different conditions, the desired cleaning and/or drying effect will either be exceeded or not achieved. Although too great a cleaning and/or drying effect results in a satisfactory washing result on one hand, it simultaneously results in a reduction of the efficiency of the dishwasher, and in particular the energy efficiency. Conversely, too modest a cleaning and/or drying effect results in an unsatisfactory washing result.

BRIEF SUMMARY OF THE INVENTION

The present invention addresses the problem of providing a dishwasher in which a satisfactory washing result can be efficiently achieved under various environmental conditions.

In the context of a dishwasher of the type cited in the introduction, this problem is solved in that the execution control device is designed to adapt at least one parameter of at least one of the washing programs to a temperature of the intake water.

In this case, a parameter of a washing program is understood to be numerical value of a characteristic variable which is used for controlling the execution of the wash cycle when a wash cycle is carried out. Such parameters may be required for e.g. command variables, command variable sequences, durations, response times, delay times, number of cycles and/or technological characteristic values of the wash cycle concerned.

The invention assumes that the actual execution of a wash cycle is essentially dependent on the inlet temperature of the supplied intake water. By adapting at least one parameter of a washing program to the inlet temperature of the intake water, the cleaning and/or drying effect of a wash cycle for a washing program can be maintained independently of the inlet temperature of the intake water. Too modest a cleaning and/or drying effect, which would lead to an unsatisfactory washing result, and too great a cleaning and/or drying effect, which would cause a decrease in the efficiency of the dishwasher, are avoided in this case. It is thus possible to achieve improved energy efficiency, time efficiency and/or operating cost efficiency while maintaining a continuously satisfactory washing result.

The dishwasher comprises in particular a receiving device for the inlet of intake water. This can be attached e.g. to an external fresh water source, in order to be able to receive fresh water from the fresh water source as intake water. Additionally or alternatively, it can optionally also be connected to a process water device which provides process water such as e.g. treated cleaned gray water or rain water as intake water or service water. In particular, a first partial quantity of the intake water can come from a cold water line and a second partial quantity from a hot water line or other hot water reservoir, such that a mixed temperature occurs for the totality of the supplied service water.

The inventive dishwasher, which is a domestic dishwasher in particular, is now configured according to the invention in such a way that its execution control device preferably reacts to the particular initial temperature of the supplied service water volume by adapting one or more parameters of the dishwashing program that is to be carried out at the time, such that it is possible in particular to conserve energy without any loss in respect of cleaning and/or drying performance.

The cleaning effect of a wash cycle is composed of in particular the hydraulic cleaning effect, the thermal cleaning effect and/or the chemical cleaning effect.

In this case, the hydraulic cleaning effect is in particular dependent on the volume flow of the dishwashing water, the spray pressure of the dishwashing water, and/or the temporal duration of the hydraulic action on the dishes. Provided the volume flow and the spray pressure are constant over the run time, the hydraulic cleaning effect is proportional to the product of volume flow, nozzle pressure and run time. If volume flow and/or nozzle pressure can vary over the run time, the mechanical cleaning effect is preferably derived from the integral of the product of volume flow and nozzle pressure over the run time. The thermal cleaning effect is generally specified in particular as an integral of the temperature over the run time, since the temperature is subject to fluctuations due to the necessary heating phases of the wash cycle. The chemical cleaning effect is preferably derived from the chemical properties of the dishwashing water and the duration of influence. Since the chemical properties of the dishwashing water can also change significantly during the course of a wash cycle, it is normally appropriate to form an integral here also.

However, there also exist numerous interactions between the cited factors of the cleaning effect. For example, the chemical composition of the dishwashing water also influences its mechanical cleaning effect. Furthermore, the temperature sequence also influences the chemical composition of the dishwashing water and hence the chemical cleaning effect. For example, the maximal dishwashing water temperature achieved during a wash cycle is crucial to whether an added detergent dissolves in the desired form and disperses in the dishwashing water.

The drying effect of a wash cycle is derived in particular from the temperature sequence during the drying cycle, the duration of the drying time, the air volume in the washing compartment, and/or air throughput through the washing compartment.

It is clear from the above that an adaptation, depending on the temperature of the fresh water, of any washing program parameter which influences the hydraulic cleaning effect, the thermal cleaning effect and/or the chemical cleaning effect of a wash cycle that is carried out on the basis of the washing program concerned, can fundamentally contribute to achieving a desired cleaning effect, in particular to constancy of the actual cleaning effect of the wash cycle. It is likewise clear that an adaptation, depending on the temperature of the fresh water, of any washing program parameter which influences the drying effect of a wash cycle that is carried out on the basis of the washing program concerned, can fundamentally contribute in particular to the constancy of the actual drying effect of the wash cycle. The actual selection of the parameter or parameters which are adapted to the temperature of the fresh water can therefore be made such that further objectives, e.g. a shortening of the run time of the wash cycle, can be achieved as effectively as possible.

In this case, the attachment device of the dishwasher can be selectively attached to different intake water sources which supply intake water of various temperatures, without having to accept adverse effects in respect of the washing result or the efficiency. It is likewise possible to attach the attachment device to an intake water source which supplies intake water of changing inlet temperature. Here too, the dishwasher can operate efficiently at all times and a satisfactory washing result can be guaranteed.

The execution control device can be designed such that the at least one parameter of the at least one washing program can be adapted to an inlet temperature range extending from e.g. 10° C. to 60° C. of the intake water. As a result, the temperature range which occurs in practice for the intake water is at least largely accommodated.

In this case, for example, the inventive dishwasher can be attached without difficulty in a conventional manner to a standard domestic cold water line which provides intake water (in particular fresh water) at a temperature of e.g. 10° C. to 20° C. In particular, however, the inventive dishwasher can be attached without difficulty to a standard domestic hot water line which provides intake water (in particular fresh water) at a temperature of e.g. 40° C. to 60° C.

In many cases, attaching the dishwasher thus to a hot water line is more energy-efficient and cost-efficient than attaching it to a cold water line. The reason for the increased cost-efficiency is that, when using hot water, the electrical energy demands of a wash cycle decrease significantly and this can result in a significant reduction in the household electricity costs. In many cases, this saving is greater than the additional costs incurred in heating the water of the hot water line. This applies in particular if the household has use of a modern condensing heating system, a cogeneration heating system or a district heating system.

However, the cost advantage can be increased even further if the household has use of a geothermal energy pump or a solar heating system for heating the intake water. In this case, the dishwasher according to the invention is particularly suitable for attaching to a geothermal energy system or to a solar energy system, since the intake water heated by such systems is in many cases subject to temperature fluctuations caused by weather conditions or seasonal conditions. In particular, the intake water can flow into the dishwasher as required from a layer store or other buffer store, in particular of a building.

In an appropriate development of the invention, the execution control device is designed to adapt a plurality of parameters in the context of at least one of the washing programs. As a rule, a plurality of parameters influence the cleaning and/or drying effect of the wash cycle that is carried out in the context of a washing program. This means that there are theoretically various ways of maintaining the constancy of the cleaning and/or drying effect that can be achieved by a wash cycle over the possible temperature range of the intake water. However, since the various adaptable parameters can influence the efficiency of the wash cycle differently in specific temperature ranges, it can be advantageous to change a plurality of parameters of a washing program depending on the temperature of the fresh water. In this way, the efficiency of the wash cycle can be further improved over the whole of the possible inlet temperature range of the intake water. Furthermore, by adapting a plurality of parameters, it is possible to avoid saturation effects when adapting the washing program to the inlet temperature of the intake water. For example, for the purpose of adapting the washing program to an increasing temperature of the intake water, a first selected parameter can be increased first and then, when this parameter has reached its maximal value, a second parameter can be changed in such a way that the desired cleaning and/or drying effect occurs.

According to an advantageous development of the invention, the execution control device is designed to adapt different parameters in the context of at least two of the washing programs. In comparison with using an execution control device which adapts the same parameter in the case of each stored washing program, the stored washing programs can be optimally adapted to the relevant application scenario in each case. For example, in the case of a delicate wash program, those parameters which could place too much stress on the dishes are excluded from any adaptation. In the case of a fast wash program, however, it can be effective to adapt precisely these parameters, in order to minimize the duration of the fast wash cycle while accepting a higher stress on the dishes.

According to an appropriate development of the invention, a plurality of values are stored in the execution control device for the at least one parameter of at least one washing program, said values being assigned to the different temperatures of the fresh water in each case. The values can be stored in the form of lists, tables, databases and the like. The respectively assigned values of the parameter or parameters can be read out and used while the relevant washing program is being carried out, depending on the current temperature of the intake water. Resource-intensive calculation steps are not required in this case. The stored values themselves can be determined e.g. by means of suitable washing trials or by means of calculation using suitable washing models for a multiplicity of similar dishwashers. The values for the parameters can generally be stored in the execution control device before the dishwasher is delivered to the customer. However, it is also possible to replace the initially stored values with at least partially modified values when servicing a dishwasher that has already been supplied, in order subsequently to improve the efficiency of a previously supplied dishwasher.

According to another appropriate development of the invention, the execution control device is designed to carry out an algorithm which is provided for calculating the at least one parameter of at least one washing program depending on the inlet temperature of the intake water, in particular fresh water. In the case of such an execution control device, the parameters are determined during the operation of the dishwasher, depending on the inlet temperature of the intake water. The amount of data to be stored in the execution control device can be reduced in this way. Therefore value tables, value lists, databases and similar are not necessarily required in this case.

According to an advantageous development of the invention, an operating element for manual input of the inlet temperature of the intake water is assigned to the execution control unit. The operating element can be moved to at least two switching states by the user of the dishwasher or by a service engineer. In this case, each of the switching states of the operating element can correspond to a temperature or a temperature range of the intake water. In a simple case, a first switching state corresponds to a low temperature of the intake water and a second switching state corresponds to a high temperature of the intake water. In this way, it is easily possible to switch between a cold water operating mode and a hot water operating mode. However, it is also possible to provide for a greater number of switching states. In this way, it is possible to increase the accuracy of the adaptation of the washing program parameters. For the purpose of selecting the switching state, the operating element can comprise buttons, rotating switches, alphanumeric input units and the like.

In another appropriate exemplary embodiment of the invention, the execution control device is assigned a sensor for determining the inlet temperature of the intake water. In this way, it is possible to ensure that the adaptation of the parameters is based on the actual temperature of the intake water. For example, errors in the manual input of the temperature of the intake water can be excluded thus. Moreover, it is also possible thus to detect fluctuations in the temperature of the intake water during a wash cycle and to take said fluctuations into consideration when adapting the parameters. Such a dishwasher is therefore particularly suitable for attaching to water sources having a fluctuating temperature, such as e.g. solar energy systems or geothermal energy systems.

According to an advantageous development of the invention, the execution control device is designed to adapt at least one such parameter of at least one of the washing programs, which parameter is a default value for an intensity of a hydraulic action on the dishes. In this way, a change in the overall cleaning effect of the wash cycle, which effect is based on a change of the inlet temperature of the intake water, can easily be balanced by a change in the hydraulic cleaning effect. Too modest a cleaning effect can be balanced by an increase in the hydraulic action and too great a cleaning effect can be balanced by a reduction in the intensity of the hydraulic action. In this way, adaptation of the temperature of the cleaning cycle can be omitted or limited in many cases. In this case, the temperature of the cleaning cycle can be maintained in a range in which the detergent that is used can optimally develop its effect. In this way, the efficiency of the wash cycle can be improved in many cases. Furthermore, by adapting the intensity of the hydraulic action, it is possible in many cases to forgo any adaptation of the timings for the cleaning cycle. It is thus possible to prevent the duration of influence of the detergent being subject to excessive fluctuations when adapting the wash cycle to the temperature of the fresh water. In particular, this prevents the duration of influence of the detergent being shortened to the extent that the now insufficient chemical cleaning effect must be balanced by means of an energy-intensive increase in the wash cycle temperature.

According to an advantageous development of the invention, the default value for the intensity of the hydraulic action in at least one of the washing programs is a default value for a rotary speed of a circulating pump for the circulation of dishwashing water. Circulating pumps which are driven by a motor, in particular an electric motor, can be controlled comparatively easily in terms of their rotary speed. It is therefore easy to influence the volume flow and/or the spray pressure of the dishwashing water.

According to an appropriate development of the invention, the adaptation of the default value for the intensity of the hydraulic action in at least one of the washing programs takes place in such a way that the intensity of the hydraulic action is increased as the inlet temperature of the intake water (in particular fresh water) rises. As a rule, a rising temperature of the intake water causes the overall cleaning cycle to be shortened due to the shorter required heating time. As a result of this, the hydraulic cleaning effect and the chemical cleaning effect decrease. The thermal cleaning effect can be increased or reduced depending on the individual case. This is because, although an increase in the temperature of the intake water is associated with an increase in the average wash temperature, the duration of thermal influence is shortened at the same time. As a rule, in the absence of further measures, the overall cleaning effect of the wash cycle decreases as the temperature of the fresh water increases in this case. By increasing the default value for the intensity of the hydraulic action, this general decease can be balanced in a simple manner.

According to an advantageous development of the invention, the execution control device is designed to adapt at least one such parameter of at least one of the washing programs, which parameter is a default value for a temporal duration of a section of the wash cycle. In this way, by adapting a parameter, it is possible to influence the thermal cleaning effect, the hydraulic cleaning effect and the chemical cleaning effect. As a result of this, an adequate adaptation of the washing program to the inlet temperature of the supplied intake water can be achieved in many cases, without having to change the intensity of the hydraulic action on the dishes for this purpose. The maximal temperatures of the heating phases of the wash cycle can likewise be held constant in many cases. Therefore both the mechanical stress and the thermal stress of the wash cycle can be held essentially constant irrespective of the inlet temperature of the intake water, and therefore adapting the duration of one or more sections of the wash cycle is suitable precisely when the underlying washing program is a delicate washing program.

According to an appropriate development of the invention, the default value for a temporal duration of a section of the wash cycle is a default value for a temporal duration of a prewash phase, an intermediate wash phase or a postwash phase in a cleaning cycle of the wash cycle. In this case, a prewash phase is understood to be a phase before the heating phase of the cleaning cycle, an intermediate wash phase to be a phase between two heating phases of the cleaning cycle, and a postwash phase to be a phase after a heating phase of the cleaning cycle. By means of adapting such parameters, the total duration of the cleaning phase can be configured such that the overall cleaning effect can be held sufficiently constant as a result of adapting the thermal cleaning effect, the hydraulic cleaning effect and/or the chemical cleaning effect at the same time.

According to an advantageous development of the invention, the adaptation of the default value for a temporal duration of a prewash phase, an intermediate wash phase and/or a postwash phase of a cleaning cycle in at least one of the washing programs is done in such a way that the temporal duration is increased if the temperature of the intake water rises. Such an adaptation makes it possible to counteract a shortening of the duration of the cleaning cycle by shortening the heating duration of the cleaning cycle if the temperature of the intake water rises, in order thus to ensure constancy of the cleaning effect.

According to an advantageous development of the invention, the default value for a temporal duration of a section of the wash cycle is a default value for a temporal duration of a prewash phase, an intermediate wash phase and/or a postwash phase of a rinsing cycle of the wash cycle. In this way, the total duration of the rinsing cycle can be adapted to the requirements of the relevant washing program.

According to an appropriate development of the invention, the adaptation of the default value for a temporal duration of a prewash phase, an intermediate wash phase and/or a postwash phase of a rinsing cycle in at least one of the washing programs is done in such a way that the temporal duration is increased if the temperature of the intake water rises. In this way, the total duration of the rinsing cycle can be set such that adequate distribution of the rinse-aid is still ensured if the heating phase of the rinsing cycle is shortened due to an increase in the temperature of the fresh water.

According to an advantageous development of the invention, the default value for a temporal duration of a section of the wash cycle is a default value for a temporal duration of a drying cycle. It is thus ensured that the desired drying effect is retained, even if the temperature of the rinsing cycle changes due to a change in the inlet temperature of the intake water.

According to an advantageous development of the invention, the execution control device is designed to adapt at least one such parameter of at least one of the washing programs, which parameter is a default value for a temperature of the wash cycle. In this way, the cleaning and/or drying effect of the wash cycle can be changed selectively and kept independent of the inlet temperature of the intake water.

According to an appropriate development of the invention, the default value for a temperature of the wash cycle in at least one of the washing programs is a default value for a maximal temperature of a cleaning cycle of the wash cycle. In this way, the cleaning effect of the wash cycle can be selectively influenced.

According to an appropriate development of the invention, the adaptation of the default value for a maximal temperature of a cleaning cycle of the wash cycle in at least one of the washing programs is done such that the maximal temperature of the cleaning cycle is increased if the inlet temperature of the intake water rises. In this way, it is possible to achieve a greater thermal cleaning effect for the same energy consumption if the inlet temperature of the intake water rises. As a result, the desired cleaning effect can be achieved in considerably less time with justifiable energy consumption. As a rule, the duration of the postwash time of the cleaning cycle can therefore be considerably shortened in this case.

According to an advantageous development of the invention, the default value for a temperature of the wash cycle in at least one of the washing programs is a default value for a maximal temperature of a rinsing cycle of the wash cycle. In this way, the duration of the rinsing cycle can be varied without specifying time constants. For example, this allows the duration of the rinsing cycle to be configured in such a way that the effective duration of the rinsing cycle is dimensioned such that the rinse-aid is sufficiently well distributed.

According to an appropriate development of the invention, the adaptation of the default value for a maximal temperature of a rinsing cycle of the wash cycle in at least one of the washing programs is done in such a way that the maximal temperature of the rinsing cycle is increased if the inlet temperature of the intake water rises. This makes it possible to utilize the increased inlet temperature of the intake water in order to achieve a higher temperature of the rinsing cycle with largely constant energy consumption. This in turn allows the temporal duration of the subsequent drying cycle to be shortened without compromising the drying effect.

BRIEF DESCRIPTION OF THE DRAWINGS

The invention and its developments and their advantages are described in greater detail below with reference to figures, in which.

DETAILED DESCRIPTION OF EXEMPLARY EMBODIMENTS OF THE PRESENT INVENTION

Elements having the same function and operation in the FIGS. 1 to 5 are denoted in each case by the same reference signs.

Figure 1:
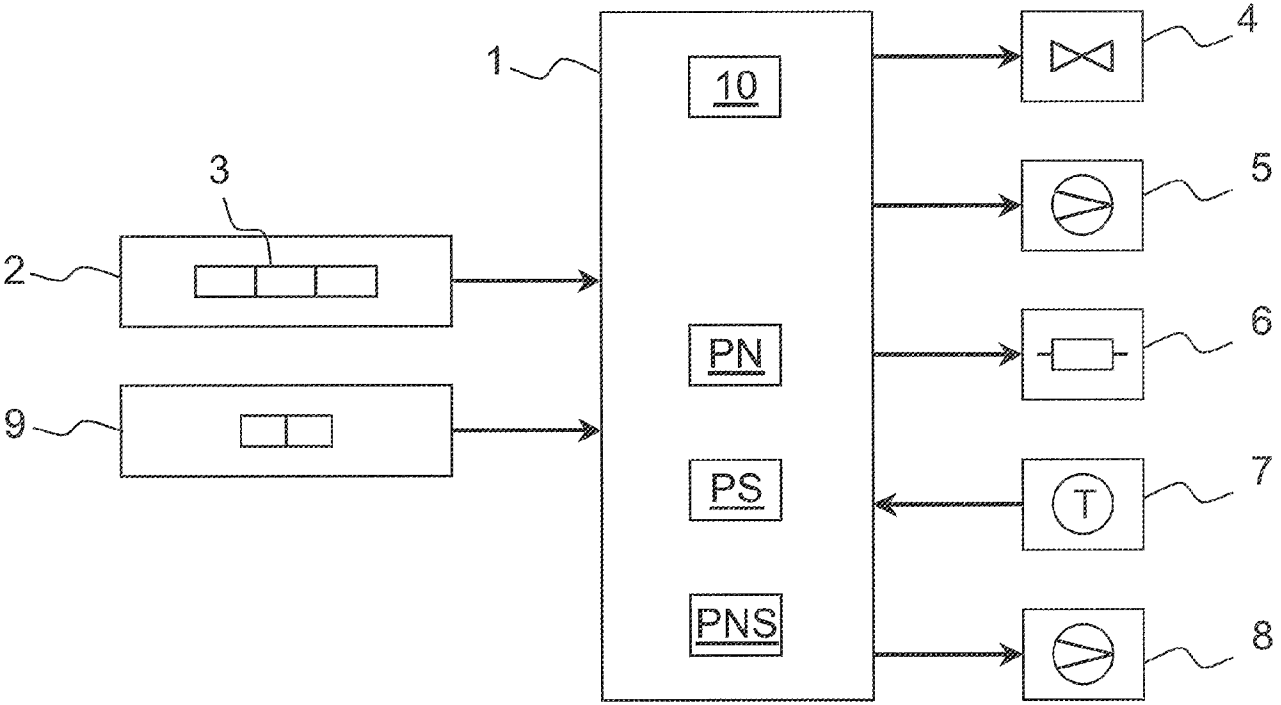
FIG. 1 shows a schematic block diagram of a first exemplary embodiment of a dishwasher according to the invention.

FIG. 1 shows a schematic block diagram of a first exemplary embodiment of a dishwasher according to the invention, in particular a domestic dishwasher. Only those dishwasher components required to understand the invention are illustrated and explained in this case.

The dishwasher features an execution control device 1, in which are stored various washing programs PN, PS, PNS for controlling an execution of a wash cycle for washing dishes. The washing program PN is a normal washing program PN, the washing program PS is a delicate washing program PS and the washing program PNS is a fast normal washing program PNS.

The normal washing program PN is provided for the purpose of achieving an average cleaning and/or drying effect, such that a satisfactory washing result can be achieved with a relatively short wash cycle duration and with relatively modest energy consumption in the case of normally soiled dishes. By contrast, the delicate washing program PS is provided for the purpose of washing delicate dishes. To this end, the delicate washing program PS is configured such that the dishes are subjected to less thermal and hydraulic stress during a wash cycle than is the case in a normal washing program PN. In this context, however, the duration of the delicate washing program PS can be longer compared with the normal washing program PN if the same cleaning and/or drying effect is to be achieved. The fast normal washing program PNS is provided for the purpose of achieving a cleaning and/or drying effect which is comparable to that of the normal washing program PN. Nonetheless, it is configured such that this defined cleaning and/or drying effect can be achieved in a shorter total time. To this end, provision is made for higher temperatures and/or greater mechanical action on the dishes during the course of a wash cycle. It is self-evident that provision can be made for further washing programs, e.g. an automatic washing program in which the profile of the wash cycle is automatically adapted to the type of load and/or volume of the load, or an intensive program in which the cleaning and/or drying effect is increased in order to achieve satisfactory dishes even in the case of heavily soiled dishes.

The execution control device 1 is assigned an operating element 2 for selecting one of the washing programs PN, PS, PNS. The operating element 2 features a push-button array 3, comprising three buttons in the exemplary embodiment as per FIG. 1, wherein each button is assigned one of the washing programs PN, PS, PNS, such that an operator can select precisely one of the washing programs PN, PS, PNS by pressing one of the buttons of the push-button array 3. When carrying out a wash cycle, the selected washing program PN, PS, PNS is processed by an execution switch mechanism (not shown) of the execution control device 1. The execution switch mechanism can be implemented in hardware from coupling elements and bistable storage elements, for example. However, the execution switch mechanism can also comprise a processor, on which software is set up as the execution switch mechanism. The washing programs or washing procedures PN, PS, PNS comprise in each case the information that is required by the execution switch mechanism for the purpose of controlling the dishwasher during a wash cycle. In particular, the washing programs PN, PS, PNS contain the regarding which steps are required in which sequence to carry out a wash cycle. In addition, the washing programs PN, PS, PNS contain the information regarding the conditions under which the execution switch mechanism should proceed from one step to the following step.

The dishwasher comprises a receiving device 4 for the inlet of intake water or service water. This can be attached to an external fresh water source, for example, in order to be able to receive fresh water from the fresh water source. Additionally or alternatively, it can also optionally be connected to a process water device, which supplies process water such as e.g. treated cleaned gray water or rain water. The receiving device can preferably be coupled to a hot water circuit, in particular a thermal solar energy system, or other hot water source which is preferably supplied by regenerative energies. This coupling can be in addition to or independent of any attachment of a cold water line to the receiving device. The receiving device 4 comprises a controllable valve, which is controlled by the execution control device 1 according to the washing program that is selected from the washing programs PN, PS, PNS. The dishwasher additionally features a circulating pump 5 and a liquid spray system which are used to deposit the intake water that is admitted into the dishwasher onto the dishes inside the washing compartment as dishwashing water. The circulating pump 5 is likewise controlled by the execution control device 1 depending on the washing program that is selected from the washing programs PN, PS, PNS.

The dishwasher also features a heating device 6 which is used to bring the circulated dishwashing water to a temperature that is specified by the relevant washing program PN, PS, PNS. In order to monitor the temperature of the dishwashing water, a sensor 7 for monitoring the temperature of the wash cycle is provided. This sensor 7 supplies its signals to the execution control device 1. In order to pump dishwashing water that is no longer required out of the dishwasher, provision is further made for a waste pump, in particular drain pump 8, which is likewise controlled by the execution control device 1 in depending on the washing program PN, PS, PNS. It is used, preferably after the execution or end of the last wash routine of the relevant selected dishwashing program, to pump the dishwashing water out of the liquid circuit, in particular out of the pump sump at and/or in the floor of the washing compartment and/or the base chassis unit or floor assembly unit of the dishwasher.

The actual execution of a real wash cycle is dependent on the relevant selected washing program PN, PS, PNS on one hand, but also on the temperature of the intake water which is received by the receiving device 4. This is because phases in which the fresh water is heated to a specified temperature last longer if the intake water is colder. The execution control device 1 is therefore designed in such a way that, in at least one of the three washing programs PN, PS, PNS, at least one parameter is automatically adapted to the temperature of the intake water. In this case, provision can advantageously be made for a plurality or preferably all of the available washing programs PN, PS, PNS to be adaptable to the temperature of the intake water.

In this way, it is possible for the relevant intended cleaning and/or drying effect of the individual washing programs PN, PS, PNS to be precisely maintained even if the dishwasher is operated at different temperatures of the intake water. In particular, the dishwasher can therefore be attached without difficulty to either a cold water source or a hot water source. The energy requirement of the dishwasher can be reduced if a hot water source is available, in particular because the energy requirement of the heating device 6 can be significantly reduced in this case. However, if a hot water connection is not available, the dishwasher can easily be attached to a cold water connection as usual. The dishwasher according to the invention is suitable in particular for attachment to water sources, in particular fresh water sources, which supply water, in particular fresh water, at varying temperatures. In this context, it is appropriate to consider in particular water supplies which include a thermal solar energy system or a geothermal energy pump. In the case of such water sources, in particular fresh water sources, the temperature of the supplied water often fluctuates depending on the season or the time of day.

In the exemplary embodiment as per FIG. 1, provision is made for an operating element 9 for inputting the temperature of the intake water. The operating element 9 allows an operator to set the anticipated temperature of the intake water manually at the execution control device 1, such that said device can selectively adapt the parameter or parameters of the washing program or washing programs PN, PS, PNS. In a simple exemplary embodiment, the operating element can have two switching, of which one can be selected by the operator in each case. A first of the switching states can then be provided for a cold water operating mode, for example, and a second of the switching states for a hot water operating mode. The setting of the switching state can then be performed by the operator on the basis of whether the intake water receiving device 4 is attached to a cold water source or a hot water source. However, exemplary embodiments are also conceivable in which more switching states are provided. This allows the parameter or parameters of the washing program or washing programs PN, PS, PNS to be adapted more accurately to the temperature of the received intake water. For this purpose, the operating element 9 can comprise push-button arrays, switches and/or an alphanumeric input unit. The operating element 9 can also be designed in such a way that the intake water temperature can be input in an infinitely variable manner. A rotatable resistor or slide resistor, for example, can be provided for this purpose.

The execution control device 1 contains a value table 10 which stores a plurality of values for each of the washing program PN, PS, PNS parameters that can be adapted to the temperature of the intake water, wherein a temperature of the fresh water is assigned to each value. Depending on the intake water temperature that is input by the operator via the operating element 9, the relevant parameters of the selected washing program PN, PS, PNS can easily be adapted by reading the corresponding values from the value table 10. A corresponding list or database could be provided instead of the value table 10.

Figure 2:
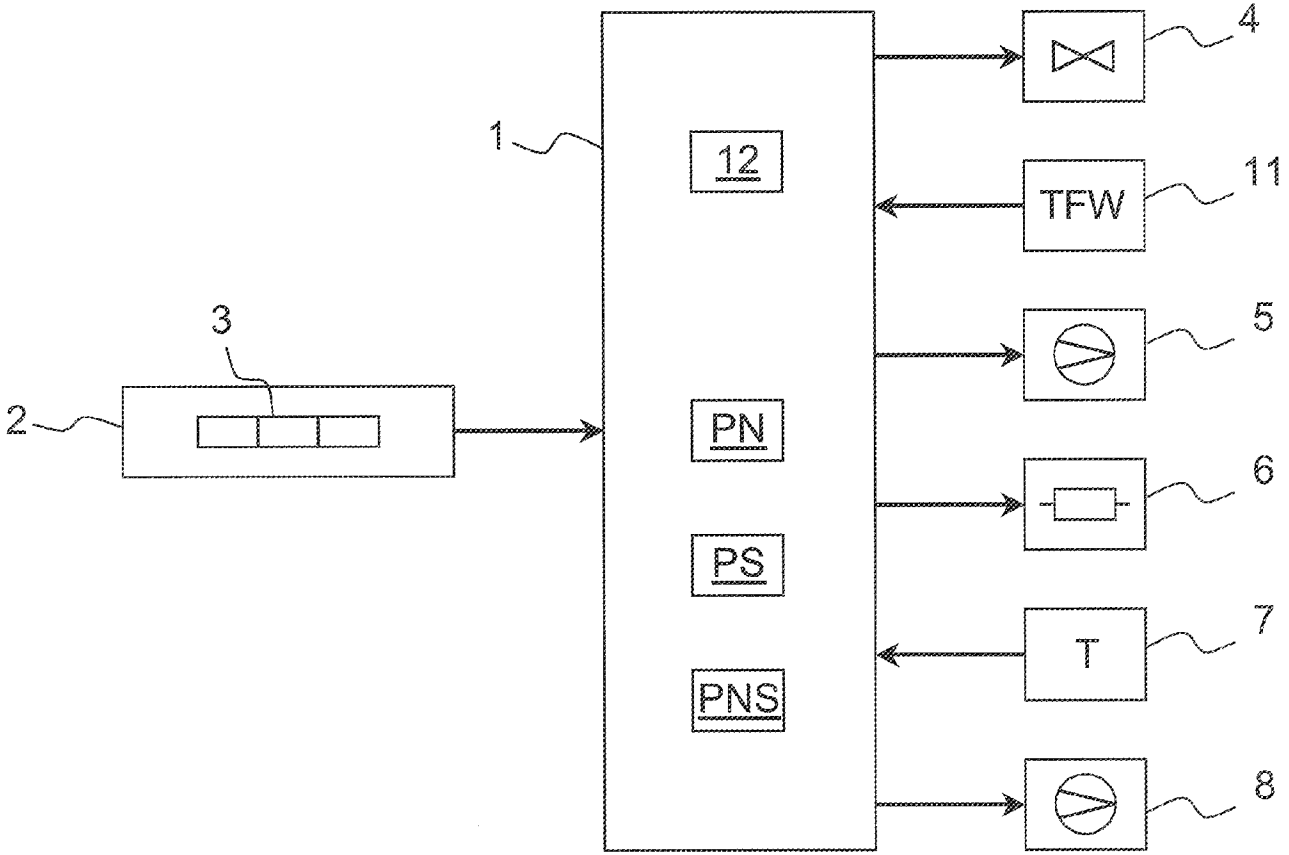
FIG. 2 shows a schematic block diagram of a second exemplary embodiment of a dishwasher according to the invention.

FIG. 2 shows a further advantageous exemplary embodiment of a dishwasher according to the invention. A first essential difference relative to the exemplary embodiment as per FIG. 1 is that the operating element for inputting the temperature of the intake water has been omitted. Instead, the dishwasher as per FIG. 2 features a sensor 11 for determining the actual temperature of the intake water. Operating errors can be avoided in this way. It is ensured at all times that the parameters of the washing programs PN, PS, PNS are adapted to the actual temperature of the intake water. In the exemplary embodiment as per FIG. 2, the adaptation of the relevant parameters of the washing programs PN, PS, PNS is done by means of an algorithm 12 which is stored in the execution control device 1 and is designed to determine optimized parameters depending on the temperature of the intake water. In this way, it is not necessary to store larger amounts of data in the execution control device 1.

Figure 3:
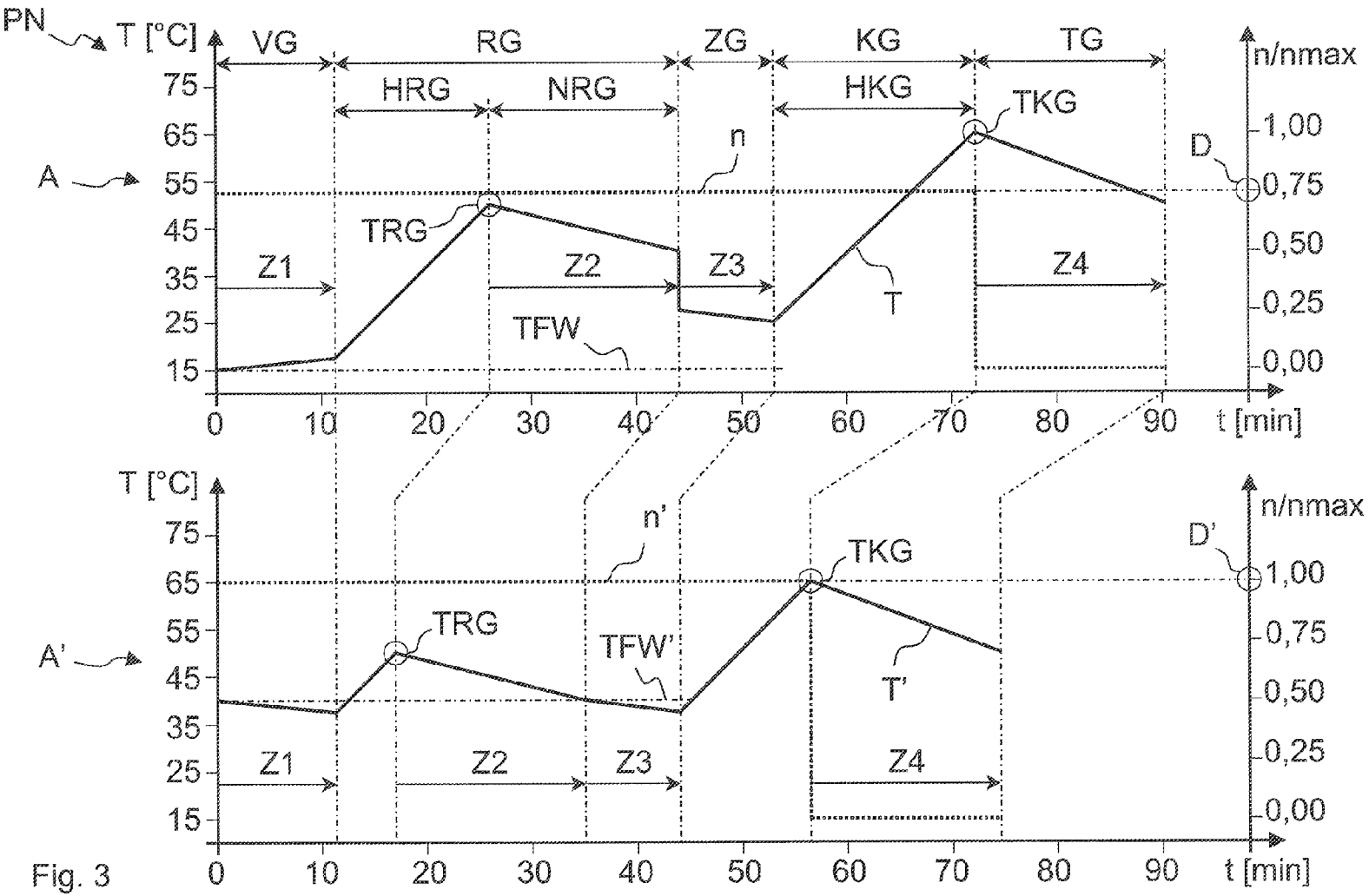
FIG. 3 shows a schematic flow diagram of the execution of a wash cycle at different temperatures of intake water in the case of a first washing program.

FIG. 3 shows an advantageous way in which a dishwasher according to the invention can function, a normal washing program PN being selected in this case. In this case, the upper region of FIG. 3 represents an execution A of a wash cycle which occurs when the normal washing program PN has been selected, if the dishwasher is attached to a cold water connection. By contrast, the lower region of FIG. 3 represents an advantageously modified execution A' of a wash cycle which occurs when the normal washing program PN has been selected, if the dishwasher is attached to a hot water connection.

In functional diagram according to FIG. 3, the time in minutes is plotted on the horizontal axis. The executions A and A' are illustrated on the same time scale to allow comparison in this case. For both executions A and A', the temperature T of the relevant wash cycle is shown in degrees ° C. on the vertical axis. The temperature T is illustrated as a continuous curve in each case. In addition, a rotary speed n of a circulating pump of the dishwasher is illustrated as a dotted line on the vertical axis for both executions A and A'. The rotary speed n of the circulating pump is illustrated in this case as a relative value with reference to a maximal rotary speed nmax. It is understood that the temperature details, the time details and the details of the relative rotary speed n/nmax of the circulating pump are exemplary.

The normal washing program PN is intended for washing normally soiled dishes which are not characterized by any particular sensitivity in relation to a thermal or mechanical stress. The illustrated wash cycle consists of a prewash cycle VG, a cleaning cycle RG, an intermediate wash cycle ZG, a rinsing cycle KG and a drying cycle TG, which are carried out consecutively in this order.

Reference is now made to the execution A, which occurs if the dishwasher is attached to a cold water source whose intake water has a temperature TFW. At the start of the prewash cycle, the dishwasher receives a defined quantity of intake water which has a temperature TFW of 15° C., for example. This intake water is circulated as dishwashing water by the activated circulating pump and one or more assigned spray devices, in particular spray arms, which are provided in the washing compartment, whereby the dishes are subjected to dishwashing water and are cleaned as a result. In this case, the rotary speed n of the circulating pump is approximately 75% of its maximal value nmax. Assuming an ambient temperature of e.g. 20° C., the temperature T of the dishwashing water rises slightly during the prewash cycle VG. The duration of the prewash cycle VG is specified by a parameter Z1 of the normal washing program PN, wherein the parameter Z1 is a default value for specifying the temporal duration of the prewash cycle VG. The parameter Z1 is selected such that the prewash cycle VG lasts long enough for heavy soiling to be removed from the dishes. At the end of the prewash cycle VG, at least some of the dishwashing water is pumped out, including the soiling contained therein.

At the start of the cleaning cycle RG, further intake water, in particular fresh water, with a temperature TWF is supplied. The cleaning cycle RG consists of a heating phase HRG of the cleaning cycle RG and a postwash phase NRG of the cleaning cycle RG. The heating phase HRG is carried out first in this case. The heating phase HRG is used to heat the dishwashing water and mechanically clean the dishes using this heated water. During the heating phase HRG, the circulating pump and the heating device of the dishwasher are also switched on in order to circulate and heat the dishwashing water. The circulating pump continues to operate at approximately 75% of its maximal rotary speed in this case. In order to increase the cleaning effect of the cleaning cycle RG, detergent is also added to the dishwashing water. The ingredients of the detergent are activated by the heated water. During the heating phase HRG, the temperature T of the dishwashing water increases considerably depending on the power of the heating device. The heating phase HRG is terminated, i.e. the heating device 6 is switched off, when the temperature T corresponds to a parameter TRG for specifying a maximal temperature of the cleaning cycle. The parameter TRG is likewise predetermined by the program PN.

The duration of the now following postwash phase NRG of the cleaning cycle RG is predetermined by a parameter Z2 of the washing program PN. The postwash phase RG is used to continue the cleaning of the dishes by means of the circulating pump which remains switched on while the heating device is switched off, wherein the temperature T of the dishwashing water drops slightly. At the end of the postwash phase NRG, the dishwashing water is at least partially pumped out, depending on the degree of soiling, and the cleaning cycle RG is terminated.

At the start of a subsequent intermediate wash cycle ZG, dishwashing water is partially or completely pumped out of the dishwasher by means of the drain pump. Intake water, in particular fresh water, having a temperature TFW is received again if appropriate for an intermediate wash, wherein the temperature T of the dishwashing water assumes a value that is higher than intake temperature TFW of the inflowing intake water due to the residual heat in the dishwasher, even without switching on the heating device. During the intermediate wash cycle, the dishwashing water is circulated further by means of the circulating pump, thereby removing detergent residues from the dishes. The temporal duration of the intermediate wash cycle ZG is predetermined by a further parameter Z3 of the washing program PN. At the end of the intermediate wash cycle ZG, the dishwashing water of the intermediate wash cycle ZG is at least partially pumped out in this case.

At the start of the temporally subsequent rinsing cycle KG, intake water (in particular fresh water) having the intake temperature TFW is received, said intake water then being circulated and heated. In this case, the rinsing cycle KG lasts until the temperature T of the dishwashing water corresponds to a parameter TKG of the washing program PN, wherein said parameter specifies the maximal temperature of the rinsing cycle KG. The dishwashing water is mixed with rinse-aid during the rinsing cycle KG. In particular, the rinse-aid reduces the surface tension of the dishwashing water, thereby preventing formation of stains on the dishes. At the end of the rinsing cycle KG, the dishwashing water is pumped out and the circulating pump is switched off.

The subsequent drying cycle TG is based on the principle that the dishes became very hot due to the high temperature T during the rinsing cycle KG, and therefore dishwashing water adhering to the dishes then evaporates during the drying cycle TG. The steam then condenses on delimiting surfaces of the dishwasher interior, these consisting of the wall surfaces of the washing compartment, and/or is carried away to the exterior. The duration of the drying cycle TG, during which the dishes cool continuously, is specified by a further parameter Z4 of the washing program PN.

The execution A' which is illustrated in the lower part of the functional diagram is likewise based on the normal washing program PN. In this case, however, the intake water (in particular fresh water) is supplied with an inlet temperature TFW' of approximately 40° C., i.e. with a higher temperature than in the case of execution A. This results in a modified temperature curve T', wherein the overall wash cycle is significantly shortened. The temporal duration of the prewash cycle VG remains unchanged in this context, since the heating device is switched off and the parameter Z1 is held constant in this phase. During the prewash cycle VG, the dishwashing water has a significantly higher temperature T' than it does in the case of profile A. Since the temperature T' of the dishwashing water at the start of the subsequent heating phase HRG of the cleaning cycle RG is significantly higher in the case of execution A' than in the case of execution A, the heating phase HRG before the desired maximal temperature TRG is reached is significantly shortened here. The duration of the postwash phase NRG of the cleaning cycle RG and the duration of the intermediate wash cycle ZG are unchanged, since the time-defining parameters Z2 and Z3 are likewise held constant. However, the temperature curve T' during the intermediate wash cycle ZG is higher than in the case of the execution A. As the temperature T' of the dishwashing water at the start of the rinsing cycle KG is likewise higher than in the previous case, the duration of the rinsing cycle KG before reaching the desired maximal temperature TKG is also shortened. No changes arise in relation to the drying cycle TG, however, since the duration is specified by the parameter Z4 which is held constant, and the initial temperature of the dishwashing water is specified by the parameter TKG which is likewise held constant.

It is clear from the above that the chemical cleaning effect of the normal washing program PN during execution A' is shortened in comparison with execution A, due to the shortened total run time of prewash cycle VG, cleaning cycle RG, intermediate wash cycle ZG and rinsing cycle KG. Due to the shortening of this time period, the thermal cleaning effect is also reduced because, despite a higher average temperature of the dishwashing water, the thermal integral is reduced. In the absence of further measures, the mechanical/hydraulic cleaning effect would also be reduced due to the shortened cleaning duration. However, an adapted parameter D' is used to specify the rotary speed n' of the circulating pump, such that the rotary speed n' of the circulating pump is raised to a higher rotary speed value than in the case A as per FIG. 3. In the exemplary embodiment here, it now corresponds to the maximal value nmax of the circulating pump. In this way, the hydraulic cleaning effect is increased in such a way that the overall cleaning effect during execution A' corresponds to the overall cleaning effect during execution A. Since there is no change to the drying cycle TG when comparing the executions A' and A, the drying effect is also held constant. It is therefore clear from the functional diagram as per FIG. 3 that, by using an adapted parameter D' for specifying the rotary speed n' of the circulating pump, a satisfactory cleaning and drying result of the wash cycle can be ensured irrespective of the inlet temperature TFW, TFW' of the intake water.

Figure 4:
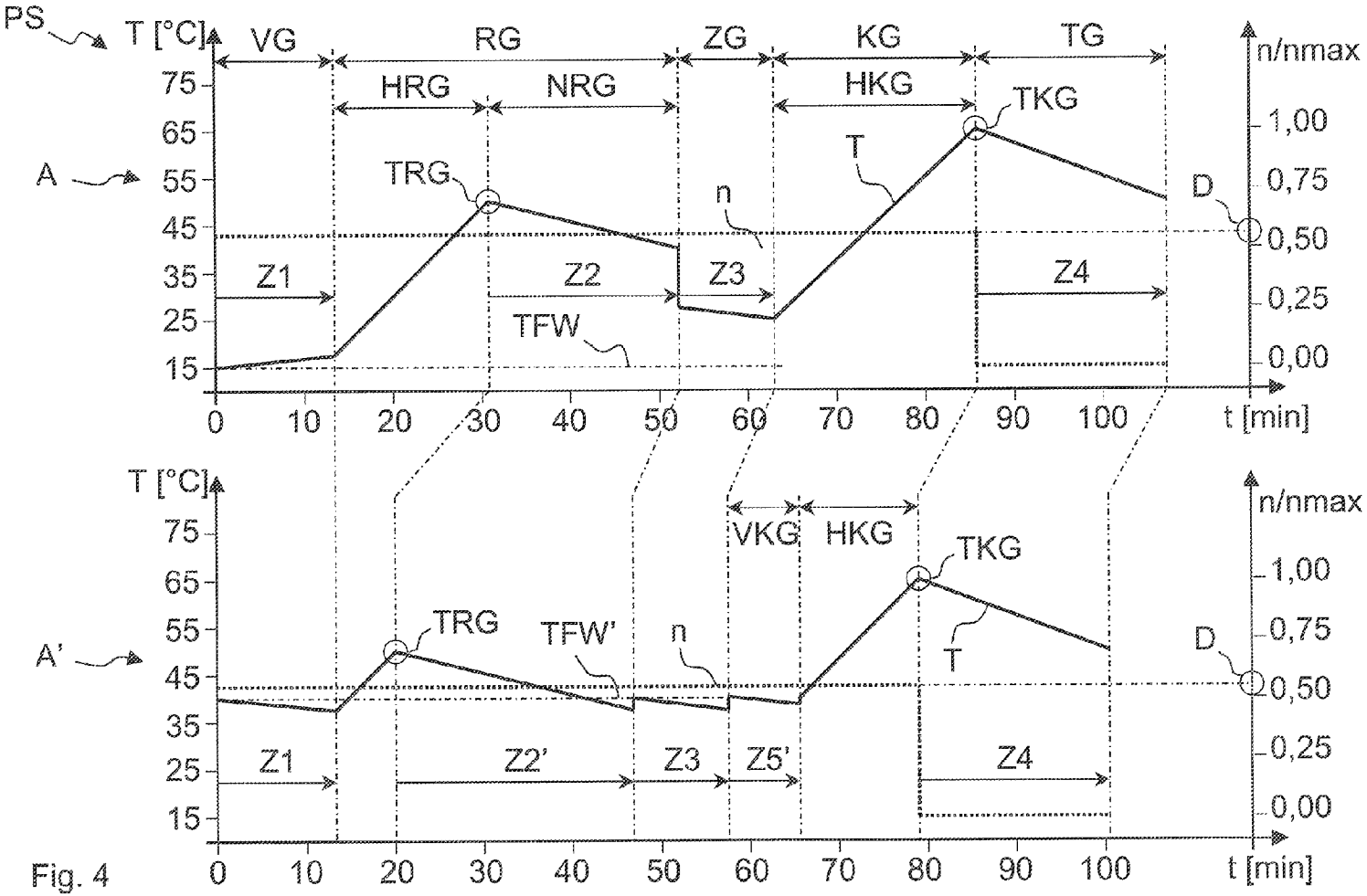
FIG. 4 shows a schematic flow diagram of the execution of a wash cycle at different temperatures of intake water in the case of a second washing program.

FIG. 4 shows a functional diagram of the dishwasher in the case of a selected delicate washing program PS. In this case, the upper region of the diagram shows an execution A of a wash cycle, which execution results from attaching the dishwasher to a cold water source whose intake water has an inlet temperature TFW. By contrast, the lower part of the diagram shows an execution A', which results from attaching the dishwasher to a hot water source whose intake water has a raised inlet temperature TFW'. The execution A as per FIG. 4 largely corresponds to the execution A as per FIG. 3. The essential difference is that the default value D for the rotary speed n of the circulating pump is reduced in order that the dishes are subjected to a lower hydraulic intensity. This ensures care of delicate dishes. In order to be able nonetheless to achieve a satisfactory washing result, the total duration of the wash cycle is lengthened relative to the case A' as per FIG. 3.

In the execution A' which is illustrated in the lower region of FIG. 4, it is evident that shortening of the heating phase HRG of the cleaning cycle RG and shortening of the heating phase HKG of the rinsing cycle KG also occur in the case of the delicate washing program PS when using intake water having a higher temperature TFW'. Whereas in the case of the normal washing program PN as per FIG. 3, the consequently reduced cleaning effect is balanced out by an increase in the rotary speed n of the circulating pump, this is not desirable in the case of a delicate washing program PS, since the intensity of the hydraulic stress on the dishes would be increased as a result of this. The parameter D is therefore held constant in the case of the delicate washing program PS.

The adaptation of the cleaning effect is instead achieved by using an adapted parameter Z2' for specifying the duration of the postwash phase NRG in the cleaning cycle RG. This parameter Z2' is defined in such a way that the temporal duration of the postwash phase NRG is increased. Moreover, a prewash phase VKG whose duration is specified by a parameter Z5' is provided during the rinsing cycle KG. In the case of execution A, when the dishwasher is attached to cold water, this parameter Z5' does not become evident since it has the value of zero. As a result of using the adapted parameters Z2' and Z5', the total duration of the wash cycles VG, RG, ZG, KG becomes longer and therefore the chemical cleaning effect, the thermal cleaning effect, and the hydraulic cleaning effect are increased. By defining the parameters Z2' and Z5' in a corresponding manner, the cleaning effect can be influenced such that it corresponds to the cleaning effect of the execution A. Since the maximal temperature TKG of the rinsing cycle KG is unchanged in the same way as the parameter Z4 for specifying the duration of the drying cycle, the drying effect is also independent of the relevant inlet temperature TFW, TFW' of the intake water.

Figure 5:
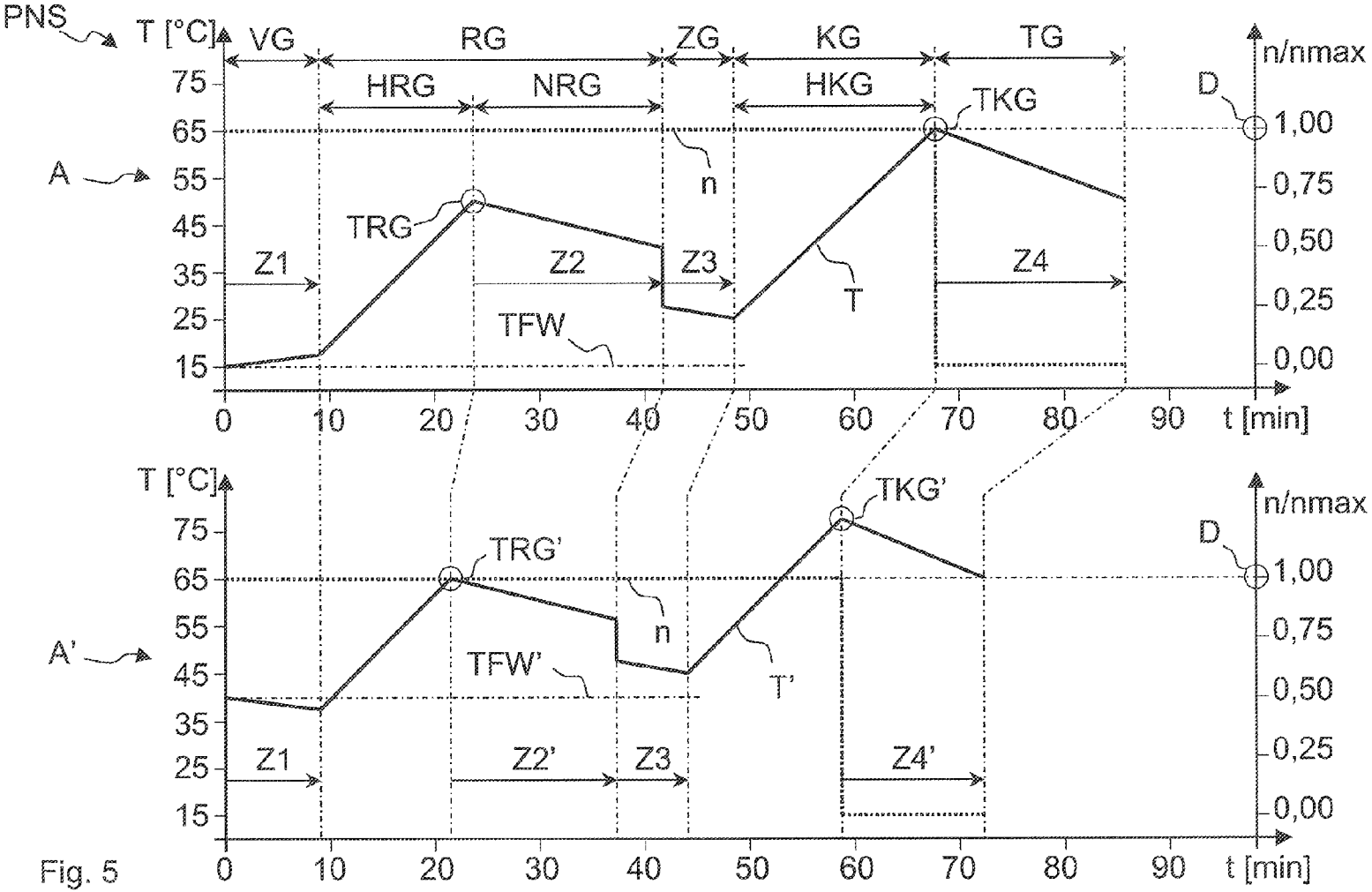
FIG. 5 shows a schematic flow diagram of the execution of a wash cycle at different temperatures of intake water in the case of a third washing program.

FIG. 5 illustrates the adaptation of a fast normal washing program PNS to the inlet temperature of the intake water TFW, TFW'. In this case, the parameter TRG for specifying the maximal temperature of the cleaning cycle RG is adapted. In comparison with a parameter TRG which is held constant, use of an increased parameter TRG' causes the heating phase HRG of the cleaning cycle RG to be shortened less or not at all when the inlet temperature TFW' of the fresh water is higher. In this case, the average temperature during the cleaning cycle RG increases relative to the case A as per FIG. 5. A maximal temperature TRG' of approximately 65° C. here is reached at the end of the heating phase HRG in the cleaning cycle RG.

Furthermore, the parameter TKG for specifying the maximal temperature of the rinsing cycle is adapted to the inlet temperature TFW, TFW' of the intake water, whereby the heating phase HKG of the rinsing cycle KG is shortened only slightly or not at all by virtue of the increased parameter TKG' if the temperature of the intake water TFW' is raised. As a result of this, the average temperature during the rinsing cycle KG and the average temperature during the following drying cycle TG are also increased. In the exemplary embodiment here, a maximal temperature TKG' of approximately 75° C. is reached in the rinsing cycle KG at the end of the heating phase HKG. In this way, both the thermal cleaning effect and the speed of the drying routine TG are increased. In this case, the duration of the postwash phase NRG and the duration of the drying cycle TG can be shortened using adapted parameters Z2' and Z4', while maintaining the same cleaning and drying performance. In the case of the fast normal washing program PNS, the energy brought in by the hot water is therefore used to increase the wash temperature. The total duration of the wash cycle can be significantly shortened thereby, without requiring a high input of electrical energy by the heating device. Moreover, since the circulating pump is operated at its maximal rotary speed nmax here in the exemplary embodiment, extremely short executions A, A' are produced for a wash cycle which is controlled according to the fast normal washing program PNS.

In an exemplary embodiment of the dishwasher according to the invention, the control unit is programmed in such a way that, in addition to a conventional variant of a washing program, i.e. in parallel with this, a special variant of the washing program is provided which is specially adapted to the use of hot water from a hot-water solar energy system.

The cleaning effect (sometimes also referred to as cleaning performance) of the dishwasher is composed of various factors. The cleaning performance is therefore derived from a sum which comprises a hydraulic factor multiplied by the run time, a factor of the thermal integral, and a chemical factor multiplied by the run time, and possibly a factor of the maximal wash temperature multiplied by the run time. By contrast, the drying effect (also called the drying performance) is derived from the sum of a temperature factor, a factor of the drying time, a factor of the air volume and a factor of the air throughput.

The special variants of the washing program are intended to hold the cleaning and drying effect constant, irrespective of the temperature of the intake water, in accordance with the above calculation formulas. A further objective is to keep the additional consumption of energy from the electricity network as low as possible.

The basic data of the above formulas for generating the variants of the washing programs can be stored in tables or formulas in software of the control unit.

If the inlet temperature of the intake water rises, in particular fresh water in the case of a known dishwasher, the run time of a washing program becomes shorter accordingly. A dishwasher according to the invention is capable of reacting to this by extending the circulation time in the cleaning step in order to compensate for the missing circulation time, by increasing the rotary speed of the circulation pump in order to compensate for the missing removal performance of the one or more spray devices, and/or by extending the circulation time of the rinsing cycle in order to guarantee the uniform distribution of the rinse-aid.

In the case of a dishwasher according to the invention, provision can be made for an operator selectable fast wash program, in which the dishwasher utilizes a higher inlet temperature of the intake water to generate higher temperatures, for the same energy consumption, than in the case of a cold water intake. As a result, it is possible to achieve the same standard of washing and drying performance in significantly shorter wash times. The higher heat input which, by virtue of the intake water of higher inlet temperature i.e. hotter intake water, can be introduced in the dishwashing water a priori during the prewash phase and rinsing phase, is utilized for the purpose of shortening the total run time of the dishwasher program compared with that using a cold water connection. This is because, compared with a cold water connection for the relevant dishwasher program, a higher thermal integral can be achieved overall for the same or less heat energy expenditure of the heating device. This can involve higher maximal temperatures or average temperatures in particular for the cleaning phase, rinsing phase, and/or drying phase. In this case, the thermal integral is derived from the total of the area below the time-linked temperature profile of the quantity of dishwashing water in the washing compartment during the total duration of the selected dishwashing program concerned. In particular, it is possible to shorten the periods for the heating phase during the cleaning routine and for the drying phase, in comparison with the case of a cold water connection.

What is claimed is:

1. A dishwasher, comprising:

an attachment device to receive intake water; and an execution control device programmed to store at least one washing program for controlling an execution of at least one wash cycle, the at least one washing program including a plurality of sections, wherein the execution control device is programmed to control the execution of the plurality of sections of the at least one washing program and to adapt a plurality of parameters of the at least one washing program based on a change in an initial measured temperature of the intake water at a commencement of a first section of the plurality of sections of the at least one washing program before the intake water is sprayed or heated, wherein the execution control device is programmed to one of:

store a plurality of values for the plurality of parameters of the plurality of sections of the at least one washing program, and assign each of the plurality of values to a respective different temperature of the intake water at the commencement of the wash program; and carry out an algorithm to calculate the plurality of parameters of the plurality of sections of the at least one washing program depending on the temperature of the intake water at the commencement of the first section of the plurality of sections.

2. The dishwasher of claim 1, wherein the dishwasher is a domestic dishwasher.

3. The dishwasher of claim 1, wherein the execution control device is programmed to adapt different parameters in at least two sections of the plurality of sections of the at least one washing program.

4. The dishwasher of claim 1, wherein the execution control device is programmed to store the plurality of values for the plurality of parameters of the plurality of sections of the at least one washing program, and wherein the execution control device is programmed to assign each of the plurality of values to a respective different temperature of the intake water at the commencement of the wash program.

5. The dishwasher of claim 1, wherein the execution control device is programmed to carry out the algorithm to calculate the plurality of parameters of the plurality of sections of the at least one washing program depending on the initial measured temperature of the intake water at the commencement of the first section of the plurality of sections.

6. The dishwasher of claim 5, further comprising an operating element to manually input the initial measured temperature of the intake water, wherein the operating element is assigned to the execution control device.

7. The dishwasher of claim 5, further comprising a sensor to determine the initial measured temperature of the intake water, wherein the sensor is assigned to the execution control device.

8. The dishwasher of claim 1, wherein the plurality of parameters includes a default value for an intensity of a hydraulic action on dishes.

9. The dishwasher of claim 8, further comprising a circulation pump to circulate dishwashing water, wherein the execution control device is programmed to associate the default value for the intensity of the hydraulic action in the at least one washing program with a rotary speed of the circulating pump.

10. A dishwasher, comprising:

an attachment device to receive intake water; and an execution control device programmed to store at least one washing program for controlling an execution of at least one wash cycle, the at least one washing program including a plurality of sections, wherein the execution control device is programmed to control the execution of the plurality of sections of the at least one washing program and to adapt a plurality of parameters of the at least one washing program based on a change in an initial measured temperature of the intake water, wherein the plurality of parameters includes a default value for an intensity of a hydraulic action on dishes, and wherein the execution control device is programmed to control an adaptation of the default value for the intensity of the hydraulic action in the at least one washing program and to increase the intensity of the hydraulic action based on an increase in the initial measured temperature of the intake water.

11. The dishwasher of claim 1, wherein the plurality of parameters includes a default value for a temporal duration of a section of the at least one wash cycle.

12. The dishwasher of claim 11, wherein the section of the at least one wash cycle is selected from the group consisting of a prewash phase, an intermediate wash phase, and a postwash phase in a cleaning cycle of the at least one wash cycle.

13. The dishwasher of claim 12, wherein the execution control device is programmed to control an adaptation of the default value for the temporal duration of one of the prewash phase, the intermediate wash phase, and the postwash phase in the cleaning cycle of the at least one washing program and to increase the temporal duration based on an increase in the initial measured temperature of the intake water.

14. The dishwasher of claim 11, wherein the section of the at least one wash cycle is selected from the group consisting of a prewash phase, an intermediate wash phase, and a postwash phase in a rinsing cycle of the at least one wash cycle.

15. The dishwasher of claim 14, wherein the execution control device is programmed to control an adaptation of the default value for the temporal duration of one of the prewash phase, the intermediate wash phase, and the postwash phase in the rinsing cycle of the at least one washing program and to increase the temporal duration based on an increase in the initial measured temperature of the intake water.

16. The dishwasher of claim 11, wherein the default value is for the temporal duration of a drying cycle of the at least one wash cycle.

17. A dishwasher, comprising:

an attachment device to receive intake water; and an execution control device to store at least one washing program for controlling an execution of at least one wash cycle, the execution control device to adapt a plurality of parameters of the at least one washing program to an initial measured temperature of the intake water at a commencement of a first section of the plurality of sections of the at least one washing program before the intake water is sprayed or heated, wherein the plurality of parameters includes a default value for a temperature of the at least one wash cycle.

18. The dishwasher of claim 17, wherein the default value for the temperature of the at least one wash cycle in the at least one washing program is a maximal temperature of a cleaning cycle of the at least one wash cycle.

19. The dishwasher of claim 18, wherein adaptation of the default value for the maximal temperature of the cleaning cycle of the at least one wash cycle in the at least one washing program is performed such that the maximal temperature of the cleaning cycle is increased if the initial measured temperature of the intake water rises.

20. The dishwasher of claim 17, wherein the default value for the temperature of the at least one wash cycle in the at least one washing program is a maximal temperature of a rinsing cycle of the at least one wash cycle.

21. The dishwasher of claim 20, wherein adaptation of the default value for the maximal temperature of the rinsing cycle of the at least one wash cycle in the at least one washing program is performed such that the maximal temperature of the rinsing cycle is increased if the initial measured temperature of the intake water rises.

22. The dishwasher of claim 1, wherein the execution control device is programmed to selectively adapt and optimize at least one parameter of a section of the plurality of sections based on the change in the initial measured temperature of the intake water.

23. A dishwasher, comprising:

an attachment device to receive intake water; and an execution control device to store at least one washing program for controlling an execution of at least one wash cycle, the execution control device to adapt a plurality of parameters of the at least one washing program to an initial measured temperature of the intake water, wherein the at least one washing program includes a plurality of sections, wherein the execution control device adapts at least one first parameter of a first section of the plurality of sections to the initial measured temperature of the intake water at a commencement of the first section of the plurality of sections of the at least one washing program before the intake water is sprayed or heated, and wherein the execution control device adapts at least one second parameter of a second section of the plurality of sections to the initial measured temperature of the intake water.

* * * * *